US011034010B2

(12) United States Patent
Kaneko et al.

(10) Patent No.: US 11,034,010 B2
(45) Date of Patent: Jun. 15, 2021

(54) HYDRAULIC HAMMERING DEVICE

(71) Applicant: Furukawa Rock Drill Co., Ltd., Tokyo (JP)

(72) Inventors: Tsutomu Kaneko, Tokyo (JP); Masahiro Koizumi, Gunma (JP); Toshio Matsuda, Gunma (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 307 days.

(21) Appl. No.: 16/065,325

(22) PCT Filed: Dec. 20, 2016

(86) PCT No.: PCT/JP2016/087916
§ 371 (c)(1),
(2) Date: Jun. 22, 2018

(87) PCT Pub. No.: WO2017/110793
PCT Pub. Date: Jun. 29, 2017

(65) Prior Publication Data

US 2019/0210205 A1 Jul. 11, 2019

(30) Foreign Application Priority Data

Dec. 24, 2015 (JP) ..... JP2015-251520

(51) Int. Cl.
*B25D 9/26* (2006.01)
*B25D 17/24* (2006.01)
(Continued)

(52) U.S. Cl.
CPC ..... *B25D 9/26* (2013.01); *B25D 17/245* (2013.01); *E21B 1/02* (2013.01); *E21C 27/12* (2013.01);
(Continued)

(58) Field of Classification Search
CPC ..... B25D 17/24; B25D 17/245; B25D 2217/0073; B25D 9/26; B25D 2222/72;
(Continued)

(56) References Cited

U.S. PATENT DOCUMENTS 4,262,755 A * 4/1981 Kuhn ..... E02D 7/10 173/131
5,056,606 A * 10/1991 Barthomeuf ..... B25D 9/145 173/13
(Continued)

FOREIGN PATENT DOCUMENTS

CN 202788599 U * 3/2013
CN 204646830 U * 9/2015
(Continued)

OTHER PUBLICATIONS

CN-202788599-U Machine Translation (Year: 2020).*
(Continued)

*Primary Examiner* — Anna K Kinsaul
*Assistant Examiner* — Veronica Martin
(74) *Attorney, Agent, or Firm* — Young Basile Hanlon & MacFarlane, P.C.

(57) ABSTRACT

A hydraulic hammering device is capable of sufficiently transmitting blow energy to bedrock while further strengthening cushioning action and suppressing damage to equipment. The device includes a pushing piston disposed behind a transmission member and having a smaller propulsive force than that of a main body, a damping piston positioned behind the pushing piston to slide reciprocally forwards and backwards and having a greater propulsive force than that of the main body, a direction-restrictor in a high-pressure circuit between pushing and damping chambers, to which hydraulic fluid is supplied for providing the pistons with propulsive forces, and a fluid supply source. The direction-
(Continued)

restrictor restricts an outflow from the chambers side to the fluid supply source side while allowing fluid inflow from the fluid supply source side to the chambers and the pushing chamber sides. A throttle in a drain circuit discharges leaked fluid from a sliding contact location to a tank.

14 Claims, 6 Drawing Sheets

(51) Int. Cl.
*E21B 1/02* (2006.01)
*E21C 27/12* (2006.01)

(52) U.S. Cl.
CPC .... *E21C 27/122* (2013.01); *B25D 2217/0073* (2013.01); *B25D 2222/72* (2013.01)

(58) Field of Classification Search
CPC ..... E21C 27/122; E21C 27/12; B25F 5/006; E21B 1/02
USPC ..... 173/210
See application file for complete search history.

(56) References Cited

U.S. PATENT DOCUMENTS

| | | | | | |
|---|---|---|---|---|---|
| 5,896,937 | A * | 4/1999 | Kaneko | B25D 9/145 | 173/105 |
| 6,318,478 | B1 * | 11/2001 | Kaneko | E21B 44/00 | 173/4 |
| 7,958,947 | B2 * | 6/2011 | Larsson | E21B 17/07 | 173/210 |
| 2001/0047873 | A1 | 12/2001 | Kaneko | | |
| 2009/0194336 | A1 * | 8/2009 | Larsson | E21B 4/14 | 175/296 |
| 2012/0305280 | A1 * | 12/2012 | Ostling | B25D 17/06 | 173/200 |
| 2015/0129269 | A1 * | 5/2015 | Muuttonen | B25D 17/245 | 173/105 |
| 2016/0318167 | A1 | 11/2016 | Pettersson | | |

FOREIGN PATENT DOCUMENTS

| | | | | | |
|---|---|---|---|---|---|
| JP | S57-178092 | A | | 11/1982 | |
| JP | 09109064 | A | * | 4/1997 | E21B 1/02 |
| JP | H09-109064 | A | | 4/1997 | |
| JP | H11-006383 | A | | 1/1999 | |
| JP | 2001-334478 | A | | 12/2001 | |
| JP | 2001-341083 | A | | 12/2001 | |
| JP | 2001334478 | A | * | 12/2001 | |
| JP | 2009-521626 | A | | 6/2009 | |
| WO | 2007/073275 | A1 | | 6/2007 | |
| WO | 2010/082871 | A1 | | 7/2010 | |
| WO | WO-2010082871 | A1 | * | 7/2010 | B25D 17/06 |
| WO | 2015/122824 | A1 | | 8/2015 | |

OTHER PUBLICATIONS

CN-204646830-U Machine Translation (Year: 2020).*
English translation of International Preliminary Report on Patentability in PCT/JP2016/087916, dated Jul. 5, 2018, 10 pages.
Extended European Search Report in corresponding Europearn Patent Application No. EP 16878682.0, dated Jan. 17, 2019, 7 pgs.
Japanese Office Action in Application No. JP 2017-558146, dated Feb. 8, 2019, and its English translation, 6 pgs.
Chinese Office Action in corresponding CN Application No. 201680073392.1, dated Aug. 25, 2020, and its English translation, 16 pgs.

* cited by examiner

HYDRAULIC HAMMERING DEVICE

TECHNICAL FIELD

This disclosure relates to a hydraulic hammering device, such as a rock drill and a breaker, for crushing bedrock and the like by delivering blows to a tool, such as a rod and a chisel.

BACKGROUND

For example, a rock drill has a shank rod 102 inserted into a front end section of a rock drill main body 100, as illustrated in FIG. 11. A rod 22 having a bit 21 for drilling attached thereto is connected to the shank rod 102 by means of a sleeve 23. When the rock drill is operated, a striking piston 131 of a striking mechanism 103 strikes a blow on the shank rod 102. The blow energy of the strike is transmitted from the shank rod 102 to the bit 21 by way of the rod 22, and the bit 21 penetrates and crushes bedrock R, which is a crushing target.

Not all of the blow energy is consumed for crushing the bedrock R, and a portion of the blow energy bounces back from the bedrock R as reflected energy Er. The reflected energy Er on this occasion is transmitted from the bit 21 to the rock drill main body 100 by way of the rod 22 and the shank rod 102. For this reason, the rock drill main body 100 temporarily retracts due to the reflected energy Er. Subsequently, the rock drill main body 100 advances by means of a propulsive force of a feeding device (illustration omitted) further than the previous position by a length of bedrock crushed by one blow, and, when the bit 21 comes into contact with the bedrock R, the striking mechanism 103 performs a next strike. A drilling operation is performed by repeating the above strokes.

As illustrated in FIG. 12, the conventional rock drill main body 100 includes a chuck driver 112 that provides rotation to the shank rod 102 through a chuck 111. To the chuck driver 112, a chuck driver bush 113 that comes into contact with a large diameter section rear end 102*b* of the shank rod 102 is held. The chuck driver bush 113 is a member that, when a forward propulsive force is provided to the rock drill main body 100, transmits the propulsive force to the shank rod 102, and reflected energy Er from the bit 21 when a strike is performed is also transmitted from the shank rod 102 to the rock drill main body 100 by way of the chuck driver bush 113.

Herein, the term "tool" may be synonymous with the bit (21), and the term "transmission members" may be a term collectively referring to a group of members including the rod (22), the sleeve (23), the shank rod (102), and the chuck driver bush (113). Note that when the hydraulic hammering device is a breaker, a rod (or a chisel) functions as both a "tool" and a "transmission member".

When the reflected energy Er is transmitted directly to the rock drill main body 100 by means of the chuck driver bush 113, there is a risk that the shock of the energy damages the rock drill main body 100. In addition, after retracting temporarily, the rock drill main body 100 is required to rapidly advance by a required distance by the time a next strike is performed.

Accordingly, a hydraulic hammering device that has a cushioning mechanism including a pushing piston 104 and a damping piston 105 disposed behind the chuck driver bush 113, as illustrated in FIG. 12, is also used. To a hydraulic circuit of the cushioning mechanism, a hydraulic pump P is connected as a fluid supply source, hydraulic fluid from the hydraulic pump P is supplied to a pushing chamber 141 so as to provide the pushing piston 104 with a propulsive force, and hydraulic fluid from the hydraulic pump P is supplied to a damping chamber 151 so as to provide the damping piston 105 with a propulsive force. The pushing chamber 141 and the damping chamber 151 communicate with each other by way of a fluid feeding hole 152. Between the cushioning mechanism and the hydraulic pump P, an accumulator 164 is disposed.

In the above configuration, when a propulsive force provided to the rock drill main body 100, a propulsive force provided to the pushing piston 104, and a propulsive force provided to the damping piston 105 are denoted by F1, F4, and F5, respectively, the propulsive forces are set in such a way as to satisfy a relation expressed by the following formula by differentiating the pressure receiving areas of the respective members (see JP H09-109064 A).

$$F4<F1<F5.$$

In FIG. 12, the reflected energy Er transmitted from the shank rod 102 to the chuck driver bush 113 is cushioned by retraction of the pushing piston 4 and the damping piston 5. Retraction kinetic energy of the pushing piston 104 and damping piston 105 (that is, the reflected energy Er) is eventually accumulated in the accumulator 164 as hydraulic fluid. The pushing piston 104 and the damping piston 105 acquire propulsive forces from hydraulic fluid discharged from the hydraulic pump P and hydraulic fluid accumulated in the accumulator 164 due to the cushioning action.

The rock drill main body 100, which temporarily retracted due to the reflected energy Er from the bedrock R, advances until reaching a predetermined striking position (a state in which the bit 21 comes into contact with the bedrock R) by the time a next strike is performed. On this occasion, because the total mass of the "transmission members" including the "tool" is substantially smaller than the mass of the rock drill main body 100, the pushing piston 104 and the damping piston 105 advance more rapidly than the rock drill main body 100 and reach an advancing stroke end of the damping piston 105.

If the bit 21 has not come into contact with the bedrock R at the timing when the damping piston 105 reaches the advancing stroke end, the pushing piston 104, separating from the damping piston 105, advances and brings the bit 21 into contact with the bedrock R by means of the transmission members. During the above advancing movement, the rock drill main body 100 also advanced, and, when the rock drill main body 100 has advanced by a predetermined distance by the time a next strike is performed by the striking mechanism 103, the pushing piston 104 begins to receive a reaction force of the propulsive force F1 of the rock drill main body 100 from the bedrock R.

The respective propulsive forces F1, F4, and F5 of the rock drill main body 100, the pushing piston 104, and the damping piston 105 satisfy a relation F4<F1<F5. When the pushing piston 104 and the damping piston 105 are at positions (hereinafter, referred to as "regular striking positions") where, because of the above relation, a reactive force F1 has caused the pushing piston 104 to retract and come into contact with the damping piston 105 and the damping piston 105 stops at an advancing stroke end and the bit 21 is brought to a state of being in contact with the bedrock R, the striking mechanism 103 performs the next strike. A drilling operation is performed by repeating the above strokes.

The regular striking positions are set so as to be in a positional relation for which, when the striking piston 131 advances and strikes a blow on the rear end of the shank rod 102, blow energy is transmitted most efficiently.

In a regular operation, the above-described drilling strokes are repeated. On the other hand, when a gap appears between the bedrock R and the bit 21 by the time the next strike is performed due to some factors, because the pushing piston 104 rapidly advances from the regular striking position and brings the bit 21 into contact with the bedrock R by means of the transmission members, the blow energy of the striking piston 131 can be transmitted to the bedrock R.

BRIEF SUMMARY

The cushioning mechanism exerts cushioning action by converting reflected energy to kinetic energy of the pushing piston and the damping piston and subsequently accumulating the converted energy in the accumulator as hydraulic fluid, and, subsequently, the hydraulic fluid accumulated in the accumulator is discharged and, after being converted to kinetic energy of the pushing piston and the damping piston, is transmitted to the rod as reflected energy again. The above mechanism including a series of actions is literally cushioning action and may be considered to be sufficiently effective in the sense that damage to the rock drill main body due to reflected energy is suppressed.

By the way, improvement of output power of a striking mechanism in a hydraulic hammering device is a problem for which many companies including the applicant have constantly sought a solution.

When blow output, blow energy per blow, and the number of blows per unit time are denoted by Ubo, Eb, and Nb, respectively, the blow output is expressed by the product of the blow energy multiplied by the number of blows, that is, the following formula:

$$Ubo=Eb\times Nb.$$

Approaches for achieving high output power include a measure of increasing the blow energy per blow, a measure of increasing the number of blows, and a case of performing both measures collectively. However, because an increase in the blow energy per blow causes reflected energy to be also increased, there is a risk that, when using the above-described conventional cushioning mechanism, reflected energy accumulated in the accumulator as hydraulic fluid is resultantly returned to the rod side again as it is and the increased reflected energy damages the transmission members, such as a rod and a sleeve.

When the number of blows is increased, a functional problem in that the accumulator suppresses an increase in pressure by converting energy of hydraulic fluid, which is an incompressible fluid, to energy of sealed gas, which is a compressible fluid, via a partition wall makes it difficult for the response speed of the accumulator to catch up with the increasing number of blows in the conventional cushioning mechanism. In other words, there is a risk that the bit becomes late for contact with the bedrock by the time a next strike is performed and cushioning action is thus not properly exerted, which causes the rock drill main body to be damaged.

In other words, the above-described conventional cushioning mechanism has a to-be-solved problem left unsolved for suppressing damage to both the rock drill main body and the transmission members when output power of the striking mechanism is to be improved.

Accordingly, the present invention has been made in view of the problem in the cushioning mechanism of the hydraulic hammering device as described above, and an object of the present invention is to provide a hydraulic hammering device that is capable of sufficiently transmitting blow energy of a striking piston to bedrock while further strengthening the cushioning action and suppressing damage to both a rock drill main body and transmission members.

In order to achieve the object mentioned above, according to an aspect of the present invention, there is provided a hydraulic hammering device including: a transmission member configured to transmit a propulsive force toward a crushing target side to a tool; a hammering mechanism configured to strike a blow on a rear portion of the transmission member; a pushing piston disposed immediately behind the transmission member, the pushing piston having a smaller propulsive force than a propulsive force of a device main body of the hydraulic hammering device; a damping piston positioned behind the pushing piston and disposed to slide reciprocally against the pushing piston in forward and backward directions, the damping piston having a greater propulsive force than the propulsive force of the device main body of the hydraulic hammering device; a pushing chamber configured to be supplied with hydraulic fluid from a fluid supply source to provide the pushing piston with the smaller propulsive force; a damping chamber configured to be supplied with hydraulic fluid from a fluid supply source to provide the damping piston with the greater propulsive force; a drain circuit that is separated from and configured to discharge a leakage of hydraulic fluid from a location of sliding contact between the pushing piston and the damping piston to a tank; a direction-restrictor provided in a high-pressure circuit between the damping chamber and the pushing chamber, and the fluid supply source, the direction restrictor being configured to restrict an outflow of hydraulic fluid from the damping chamber side and the pushing chamber side to the fluid supply source side, while allowing an inflow of hydraulic fluid from the fluid supply source side to the damping chamber side and the pushing chamber side; and a throttle provided in the drain circuit.

In the hydraulic hammering device according to the one aspect of the present invention, when the striking mechanism strikes a blow on the tool by means of the transmission member, the tool penetrates and crushes a crushing target by means of blow energy of the strike. Because reflected energy at this time is transmitted from the tool to the hydraulic hammering device by way of the transmission member, the hydraulic hammering device temporarily retracts due to the reflected energy and, after the hydraulic hammering device has advanced by means of a propulsive force provided to the device main body, the striking mechanism performs a next strike.

The reflected energy transmitted from the tool to the transmission member is cushioned by retraction action of the pushing piston and the damping piston (hereinafter, also referred to as a "cushioning mechanism"). On this occasion, according to the hydraulic hammering device according to the one aspect of the present invention, hydraulic fluid in the pushing chamber and the damping chamber has an "outflow" thereof to the fluid supply source side restricted by the direction-restricting means.

For this reason, the hydraulic fluid in both chambers, which has nowhere to go, leaks from clearance at a location of sliding contact between members of the pushing piston and the damping piston, which slide against each other, accompanied by a high pressure gradient (that is, heat generation). The leakage of hydraulic fluid from the cushioning mechanism has its flow rate adjusted by the throttle interposed in the drain circuit and controls cushioning action.

When a completed cushioning stroke transitions to an advancing stroke, in the cushioning mechanism of the hydraulic hammering device according to the one aspect of the present invention, the pushing piston and the damping piston may exert respective predetermined propulsive forces without delay because, the state of hydraulic fluid supplied to the damping chamber side and the pushing chamber side from the fluid supply source is maintained (allowed) by the direction-restricting means.

As described above, in the hydraulic hammering device according to the one aspect of the present invention, converting reflected energy to leakage of hydraulic fluid accompanied by heat generation causes cushioning action to be exerted. Because the hydraulic fluid having leaked is collected to a tank with heat energy retained, energy equivalent to the heat energy is consumed. In other words, it can be said that, the cushioning mechanism of the hydraulic hammering device according to the one aspect of the present invention is a mechanism exerting damping action.

Therefore, because the hydraulic hammering device according to the one aspect of the present invention enables the amount of energy returned to the transmission member to be reduced by means of the cushioning mechanism exerting damping action, it is possible to reduce damage to the transmission member, and the hydraulic hammering device is suitable for, in particular, a striking mechanism capable of delivering a high blow energy.

In addition, the cushioning mechanism of the hydraulic hammering device according to the one aspect of the present invention may always maintain cushioning action properly because the response speed of the direction-restricting means is sufficiently high. For this reason, it is possible to reduce damage to the rock drill main body in a stable manner, and the cushioning mechanism is suitable for, in particular, a striking mechanism capable of delivering a large number of blows.

In the advancing stroke, because the state of hydraulic fluid supplied from the fluid supply source is maintained (allowed), the pushing piston and the damping piston advance to predetermined positions (that is, regular striking positions) rapidly and, while the bit is in a state of being in contact with the bedrock, a next strike is performed. In addition, when a gap appears between the bedrock and the bit by the time the next strike is performed due to some factors, because the pushing piston rapidly advances from the regular striking position and brings the bit into contact with the bedrock, blow energy of the striking piston may be transmitted to the bedrock.

As described above, the hydraulic hammering device according to the one aspect of the present invention is capable of sufficiently transmitting blow energy of a striking piston to bedrock while further strengthening the cushioning action and suppressing damage to both a rock drill main body and transmission members.

DETAILED DESCRIPTION

Hereinafter, an embodiment of the present invention will be described with reference to the drawings as appropriate. Note that the drawings are schematic. Therefore, it should be noted that relations between thicknesses and planar dimensions, ratios, and the like are different from actual ones and portions having different dimensional relationships and ratios from one another among the drawings are included. In addition, the following embodiment indicates devices and methods to embody the technical idea of the present invention by way of example, and the technical idea of the present invention does not limit the materials, shapes, structures, arrangements, and the like of the constituent components to those described below.

First Embodiment

Figure 1:
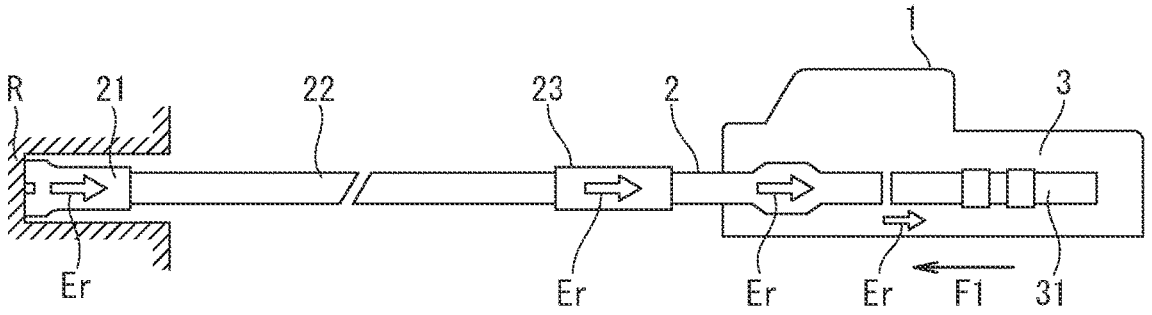
FIG. 1 is an explanatory diagram of a basic configuration of a rock drill indicative of an embodiment of a hydraulic hammering device according to one aspect of the present invention.

In a basic configuration of a rock drill of the present embodiment, as illustrated in FIG. 1, a shank rod 2 is inserted into a front end section of a rock drill main body 1 and a striking mechanism 3 for delivering a blow to the shank rod 2 is disposed behind the shank rod 2. A rod 22 having a bit 21 for drilling attached thereto is connected to the shank rod 2 by means of a sleeve 23.

Figure 2:
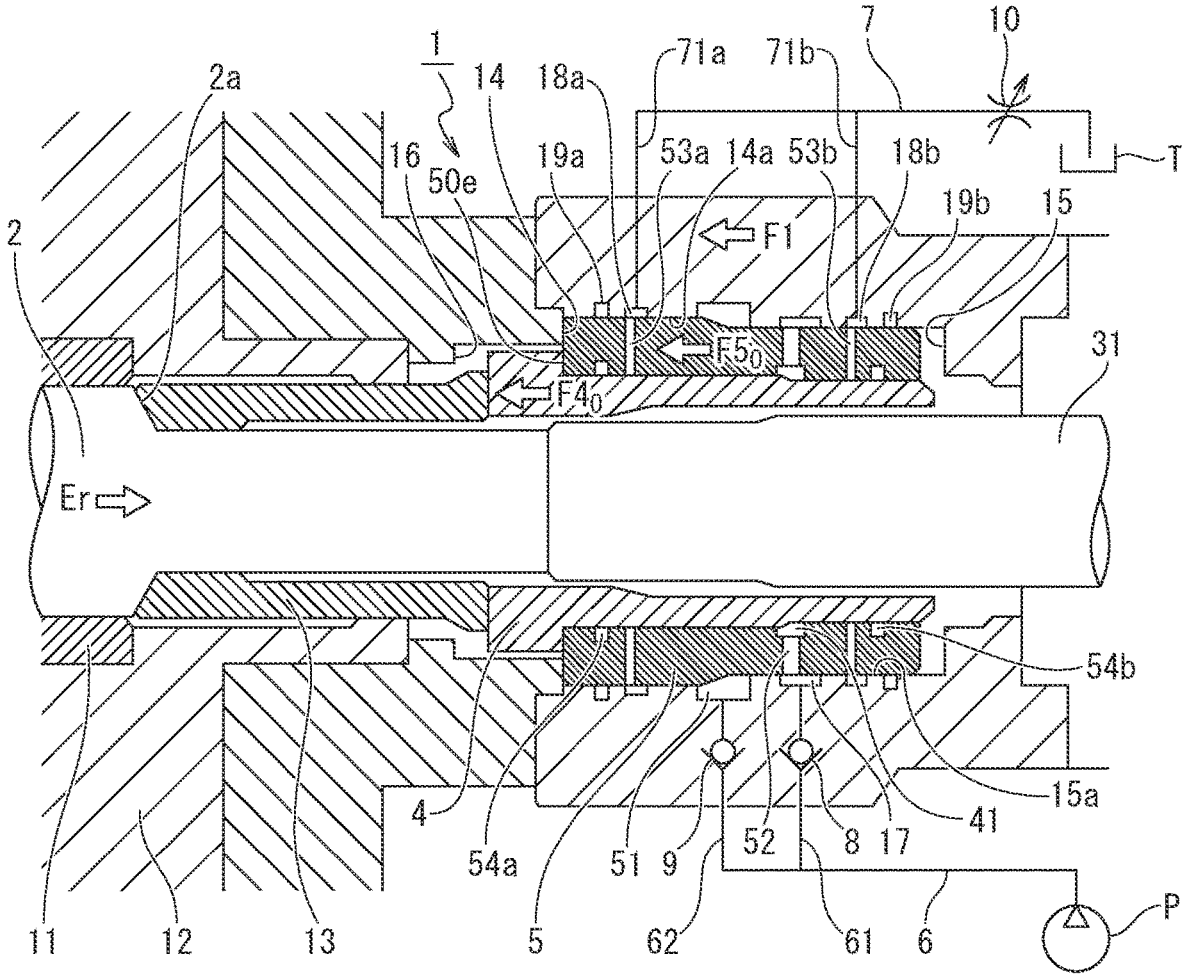
FIG. 2 is a longitudinal sectional view of a cushioning mechanism of a rock drill indicative of a first embodiment of the present invention.

As illustrated in FIG. 2, the rock drill main body 1 includes a chuck driver 12 that provides rotation to the shank rod 2 through a chuck 11. To the chuck driver 12, a chuck driver bush 13 that comes into contact with a large diameter section rear end 2*a* of the shank rod 2 is held slidably in the forward and backward directions inside the chuck driver 12. A pushing piston 4 and a damping piston 5 are disposed behind the chuck driver bush 13 and form a cushioning mechanism.

Figure 3:
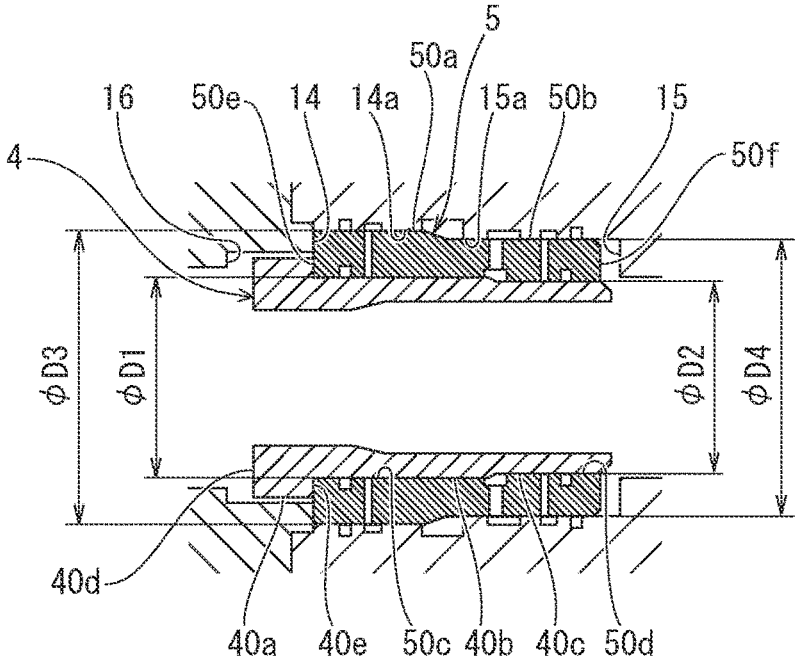
FIG. 3 is a detailed explanatory diagram of a main portion of the cushioning mechanism in FIG. 2.

The damping piston 5 is a circular cylindrical piston on the front and the rear of which in the longitudinal direction a front end face 50*e* and a rear end face 50*f* are formed, respectively, as illustrated in FIG. 3. The damping piston 5 has an outer large diameter section 50*a* and an outer small diameter section 50*b* on the outer peripheral surface of the circular cylindrical shape of the damping piston 5 and, in conjunction therewith, has an inner large diameter section 50*c* and an inner small diameter section 50*d* on the inner peripheral surface of the circular cylindrical shape of the damping piston 5.

As illustrated in FIG. 2, a middle step section 14 and a rear step section 15 are formed on the rock drill main body 1. The damping piston 5 is held movable in the forward and backward directions between the middle step section 14 and the rear step section 15. The damping piston 5 has the outer large diameter section 50*a* and the outer small diameter section 50*b* coming into sliding contact with an inner large diameter section 14*a* on the side on which the middle step section 14 is formed and an inner small diameter section 15*a* on the side on which the rear step section 15 is formed, respectively.

The damping piston 5 has, as communication holes making the outer diameter side and the inner diameter side thereof communicate with each other, a drain hole 53*a*, a fluid feeding hole 52, and a drain hole 53*b* formed in this order from the front to the rear. An annular pushing chamber 41 is formed on the inner diameter side of the fluid feeding hole 52, and, with the pushing chamber 41 as a boundary, the front side and the rear side serve as the above-described inner large diameter section 50*c* and the above-described inner small diameter section 50*d*, respectively. In addition, a seal 54*a* and a seal 54*b* are formed on the inner peripheral surface on the front side of the drain hole 53*a* and on the inner peripheral surface on the rear side of the drain hole 53*b*, respectively The pushing piston 4 is, as illustrated in FIG. 3, a flanged circular cylindrical piston and has, on the outer peripheral surface of the circular cylindrical shape thereof, an outer large diameter section 40*a*, an outer medium diameter section 40*b*, and an outer small diameter section 40*c* formed in this order from the front to the rear. A front end face 40*d* and a middle end face 40*e* are formed on the front side of the outer large diameter section 40*a*, which has a flange shape, and on the rear side of the flange shape, respectively.

As illustrated in FIG. 2, a front step section 16 is formed on the rock drill main body 1, and the pushing piston 4 is held so that the outer large diameter section 40*a* thereof, which has a flange shape, is movable in the forward and backward directions between the front step section 16 and the front end face 50*e* of the damping piston 5. The pushing piston 4 and the damping piston 5 have the medium diameter section 40*b* and the inner large diameter section 50*c* coming into sliding contact with each other and the small diameter section 40*c* and the inner small diameter section 50*d* coming into sliding contact with each other. Note that, although a small diameter section and a large diameter section are formed on a front side portion and a rear side portion of the inner peripheral surface of the pushing piston 4 of the present embodiment, respectively, the small diameter section and the large diameter section are shapes for avoiding interference with a striking piston 31 and do not have any influence on a cushioning function.

On the inner large diameter section 14*a* of the inner peripheral surface of the rock drill main body 1, a drain port 18*a* is formed at a position facing the drain hole 53*a* of the damping piston 5, as illustrated in FIG. 2. On the front side of the drain port 18*a*, a seal 19*a* is formed. Further, on the inner small diameter section 15*a* of the inner peripheral surface of the rock drill main body 1, a pushing port 17 is formed at a position facing the fluid feeding hole 52 of the damping piston 5. On the inner small diameter section 15*a* of the rock drill main body 1, a drain port 18*b* is formed at a position facing the drain hole 53*b*, and a seal 19*b* is formed on the rear side of the drain port 18*b*. At the boundary between the inner large diameter section 14*a* and the inner small diameter section 15*a*, a damping chamber 51 is formed.

To the rock drill main body 1, a hydraulic pump P is connected by way of a high-pressure circuit 6, and, in conjunction therewith, a tank T is connected by way of a drain circuit 7. In the present embodiment, one end of the high-pressure circuit 6 is connected to the hydraulic pump P and the other end splits into a pushing passage 61 and a damping passage 62, and the pushing passage 61 and the damping passage 62 are connected to the pushing port 17 and the damping chamber 51, respectively.

In the above configuration, a check valve 8 is interposed in the pushing passage 61. The check valve 8 is provided as a direction-restricting means for, while allowing an inflow of hydraulic fluid from the side on which the hydraulic pump P is placed to the side on which the pushing port 17 is formed, restricting an outflow of hydraulic fluid from the side on which the pushing port 17 is formed to the side on which the hydraulic pump P is placed.

In addition, a check valve 9 is interposed in the damping passage 62. The check valve 9 is provided as a direction-restricting means for, while allowing an inflow of hydraulic fluid from the side on which the hydraulic pump P is placed to the side on which the damping chamber 51 is formed, restricting an outflow of hydraulic fluid from the side on which the damping chamber 51 is formed to the side on which the hydraulic pump is placed.

The tank T is connected to one end of the drain circuit 7, and the other end of the drain circuit 7 splits into a drain passage 71*a* and a drain passage 71*b*. The drain passage 71*a* and the drain passage 71*b* are connected to the drain port 18*a* and the drain port 18*b*, respectively. A variable throttle 10 is interposed in the drain circuit 7.

In the above configuration, when, as illustrated in FIG. 3, among the outer diameters of the pushing piston 4, the diameter of the outer medium diameter section 40*b* formed on the front side of the pushing chamber 41 and the diameter of the outer small diameter section 40*c* formed on the rear side of the pushing chamber 41 are denoted by D1 and D2, respectively, and hydraulic pressure in the pushing chamber 41 is denoted by Pd1, a propulsive force $F4_0$ with which the pushing chamber 41 provides the pushing piston 4 is expressed by formula (1) below:

$$F4_0=\pi(D1^2-D2^2)Pd1/4 \quad (1).$$

On the other hand, when, among the outer diameters of the damping piston 5, the diameter of the outer large diameter section 50*a* formed on the front side of the damping chamber 51 and the diameter of the outer small diameter section 50*b* formed on the rear side of the damping chamber 51 are denoted by D3 and D4, respectively, because hydraulic pressure in the damping chamber 51 is the same as the hydraulic pressure Pd1 in the pushing chamber 41, a propulsive force $F5_0$ with which the damping chamber 51 provides the damping piston 5 is expressed by formula (2) below:

$$F5_0=\pi(D3^2-D4^2)Pd1/4 \quad (2).$$

When a propulsive force provided to the rock drill main body 1 is denoted by F1, the above-described propulsive force F40, propulsive force F50, and propulsive force F1 are set so as to satisfy a relation expressed by formula (3) below:

$$F4_0<F1<F5_0 \quad (3).$$

Next, an operation of the above-described rock drill main body 1 will be described.

In a drilling operation, when the striking piston 31 of the striking mechanism 3 strikes a blow on the shank rod 2, blow energy of the striking piston 31 is transmitted from the shank rod 2 to the bit 21 by way of the rod 22, and the bit 21 penetrates and crushes bedrock R, which is a crushing target. Reflected energy Er at this time is transmitted from the bit 21 to the pushing piston 4 by way of the rod 22, the shank rod 2, and the chuck driver bush 13.

In the case where the reflected energy Er is transmitted when the pushing piston 4 and the damping piston 5 are in a state in which the pushing piston 4 is in contact with the damping piston 5, that is, at regular striking positions as illustrated in FIG. 1, the pushing piston 4 and the damping piston 5 retract in one body relatively to the rock drill main body 1. Locations of sliding contact at this time are between the inner peripheral surfaces (the inner large diameter section 14*a* and the inner small diameter section 15*a*) of the rock drill main body 1 and the outer peripheral surfaces (the outer large diameter section 50*a* and the outer small diameter section 50*b*) of the damping piston 5. When the damping piston 5 retracts, hydraulic fluid in the damping chamber 51 has the pressure thereof raised because an outflow thereof to the side on which the hydraulic pump P is placed is restricted by the check valve 9 and leaks accompanied by heat generation from clearance at the above-described locations of sliding contact.

Because the hydraulic fluid leaked from the clearance at the locations of sliding contact is collected to the tank T with heat energy retained, the reflected energy Er is damped by consuming energy equivalent to the heat energy. On this occasion, while the leaking hydraulic fluid is discharged to the tank T by way of the drain ports 18*a* and 18*b* and the drain circuit 7, the variable throttle 10 is interposed in the drain circuit 7 and controls the upper limit of the amount of leakage of the leaking hydraulic fluid, that is, the amount of consumed fluid in the damper.

In the case where the reflected energy Er is transmitted when the pushing piston 4 is at a position to which the pushing piston 4, having separated from the damping piston 5, has advanced (for example, a position at which the front end face 40*d* comes into contact with the front step section 16), the pushing piston 4 retracts relatively to the damping piston 5 and, in conjunction therewith, the damping piston 5 retracts relatively to the rock drill main body 1.

Locations of sliding contact at this time are between the outer peripheral surfaces (the outer medium diameter section 40*b* and the outer small diameter section 40*c*) of the pushing piston 4 and the inner peripheral surfaces (the inner large diameter section 50*c* and the inner small diameter section 50*d*) of the damping piston 5 and between the inner peripheral surfaces (the inner large diameter section 14*a* and the inner small diameter section 15*a*) of the rock drill main body 1 and the outer peripheral surfaces (the outer large diameter section 50*a* and the outer small diameter section 50*b*) of the damping piston 5.

When the pushing piston 4 retracts, hydraulic fluid in the pushing chamber 41 has an outflow thereof to the side on which the hydraulic pump P is placed restricted by the check valve 8. In addition, when the damping piston 5 retracts, hydraulic fluid in the damping chamber 51 has an outflow thereof to the side on which the hydraulic pump P is placed restricted by the check valve 9. For this reason, the hydraulic fluid in the pushing chamber 41 and the damping chamber 51, which has nowhere to go, has its pressure raised and leaks from clearance at the afore-described locations of sliding contact accompanied by a high pressure gradient (that is, heat generation) into the drain circuit 7 which is separate from the pushing chamber 41 and the damping chamber 51.

Because the hydraulic fluid that is leaked is collected to the tank T with heat energy retained, the reflected energy Er is damped by consuming energy equivalent to the heat energy. On this occasion, while the leaking hydraulic fluid is discharged to the tank T by way of the drain holes 53*a* and 53*b*, the drain ports 18*a* and 18*b*, the drain passages 71*a* and 71*b*, and the drain circuit 7, the variable throttle 10 is interposed in the drain circuit 7 and controls the upper limit of the amount of leakage of the leaking hydraulic fluid, that is, the amount of consumed fluid in the damper.

When a cushioning propulsive force provided by the pushing chamber 41 to the pushing piston 4 and a cushioning propulsive force provided by the damping chamber 51 to the damping piston 5 on the occasion where the pushing piston 4 and the damping piston 5 retract, that is, on the occasion where cushioning action is exerted, are denoted by $F4_1$ and $F5_1$, respectively, adjustment of the degree of opening of the variable throttle 10 enables the cushioning propulsive force $F4_1$ and the cushioning propulsive force $F5_1$ to be respectively controlled to predetermined setting values.

In other words, a relationship among the cushioning propulsive force $F4_1$, the cushioning propulsive force $F5_1$, and the afore-described formula (1) is expressed by the formulas (4) and (5), and the degree of opening of the variable throttle 10 is adjusted to a value in a range between values satisfying formulas (4) and (5):

(A) when the degree of opening of the variable throttle 10 is set at a maximum value (equal to a lower limit of throttling effect), $$F1<F4_1\min<F5_1\min \tag{4}$$

where $F4_0<F4_1\min$ and $F5_0<F5_1\min$; and (B) when the degree of opening of the variable throttle 10 is set at the full close position (equal to an upper limit of throttling effect), $$F1<F4_1\max=F5_1\max \tag{5}$$

where $F5_1\min<F4_1\max=F5_1\max$.

In the case where the reflected energy Er is transmitted when the pushing piston 4 is at a position to which the pushing piston 4 has advanced further than the damping piston 5, because the cushioning propulsive force $F4_1$ of the pushing piston 4 is smaller than the cushioning propulsive force $F5_1$ of the damping piston 5, the pushing piston 4 retracts. First, the middle end face 40*e* comes into contact with the front end face 50*e*, and, eventually, the pushing piston 4 and the damping piston 5 retract in one body.

In the above operation, because the cushioning propulsive force $F4_1$ is greater than the cushioning propulsive force $F4_0$, initial cushioning action performed by the pushing piston 4 is sufficiently effective. For example, although, in a phase in which the pushing piston 4 retracts and comes into contact with the damping piston 5, both members, the pushing piston 4 and the damping piston 5, strike against each other, the cushioning mechanism of the present embodiment has an advantageous effect of enabling striking speed to be reduced to a slower speed and noise to be thereby suppressed to a lower level than the conventional cushioning mechanism described using FIG. 12.

When the pushing piston 4 and the damping piston 5 have retracted by a predetermined distance (for example, until the rear end face 50*f* comes into contact with the rear step section 15), the reflected energy Er has, while being sufficiently damped, been transmitted to the rock drill main body 1, and a cushioning stroke is finished.

Because the cushioning mechanism of the present embodiment enables the pushing piston 4 and the damping piston 5 to always exert cushioning action accompanied by damping action in a stable manner, damage to the rock drill main body 1, a tool, and transmission members may be reduced. The cushioning stroke means a stroke in which the reflected energy Er from the bedrock R is transmitted and the pushing piston 4 and the damping piston 5, while retracting, exert cushioning action accompanied by damping action.

The rock drill main body 1, which temporarily retracted due to the reflected energy Er from the bedrock R, advances until reaching a state in which the bit 21 comes into contact with the bedrock R, that is, to a predetermined striking position, by the time a next strike is performed. On this occasion, because the total mass of the transmission members including the tool is substantially smaller than the mass of the rock drill main body 1, the pushing piston 4 and the damping piston 5 advance more rapidly than the rock drill main body 1 and, after advancing to an advancing stroke end of the damping piston 5, that is, a reference position at which the front end face 50*e* comes into contact with the middle step section 14, stops.

If the bit 21 has not come into contact with the bedrock R at the timing when the damping piston 5 reaches the advancing stroke end, the pushing piston 4, separating from the damping piston 5, advances and brings the bit 21 into contact with the bedrock R by means of the transmission members. During the above advancing movement, the rock drill main body 1 also advances, and, subsequently, the rock drill main body 1, which is in a state in which the damping piston 5 is in contact with the front end face 50*e* of the rock drill main body 1, catches up with and comes into contact with the pushing piston by the time a next strike is performed by the striking mechanism 3.

Because the propulsive forces F1, $F4_0$, and $F5_0$ provided to the rock drill main body 1, the pushing piston 4, and the damping piston 5, respectively, satisfy a relation $F4_0<F1<F5_0$, the striking mechanism 3 performs a next strike in a state in which a reactive force F1 causes the pushing piston 4 to retract and come into contact with the damping piston 5 and the damping piston 5 stops at the advancing stroke end (i.e. the rock drill main body 1, the pushing piston 4, and the damping piston 5 are at the regular striking positions), and the bit 21 is in contact with the bedrock R, and the propulsive force F1 is acting.

Although, in a regular operation, the above-described drilling stroke is repeated, when a gap appears between the bedrock R and the bit 21 by the time the next strike is performed due to some factors, the pushing piston 4 rapidly advances from the regular striking position and brings the bit 21 into contact with the bedrock R by means of the transmission members. This operation enables the blow energy of the striking piston 31 to be transmitted to the bedrock R. Note that a stroke in which, after the cushioning stroke, the pushing piston 4 and the damping piston 5 advance and bring the bit 21 to a state of being in contact with the bedrock R is referred to as an advancing stroke.

While the advancing stroke is required to be performed rapidly after the cushioning stroke has been finished, the damping chamber 51 and the pushing chamber 41 substantially excel in responsiveness because of, while having hydraulic fluid therein restricted to flow out to the side on which the hydraulic pump P is placed by the check valves 9 and 8, respectively, being always supplied with hydraulic fluid from the side on which the hydraulic pump P is placed, which causes the advancing stroke to be performed rapidly.

Figure 4A:
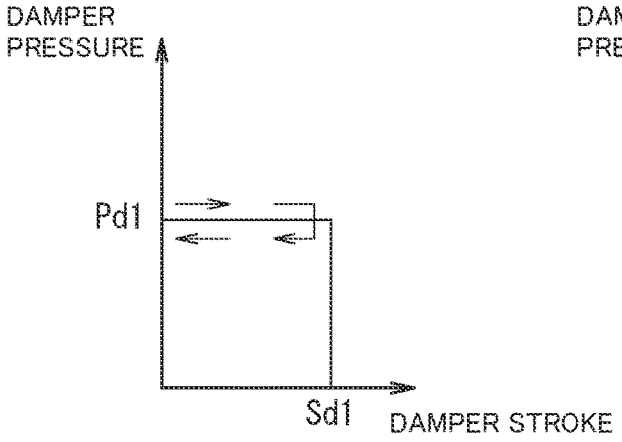
FIGS. 4A and 4B are operational explanatory diagrams of the cushioning mechanism in FIG. 2 and each drawing illustrates a relationship between displacement and pressure of a damping piston.
Figure 4B:
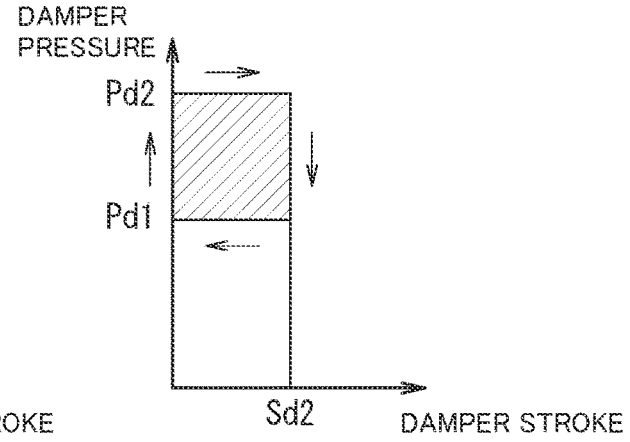

Next, damping action and operational effects thereof in the cushioning stroke of the present embodiment will be described with reference to FIGS. 4A, 4B, and 5 as appropriate. FIGS. 4A and 4B are diagrams schematically illustrating a relationship between a stroke of the damping piston 5 and pressure in the damping chamber 51 in the cushioning stroke and illustrates a case of the conventional cushioning mechanism described in FIG. 12 and a case of the cushioning mechanism of the present embodiment in FIGS. 4A and 4B, respectively, in a comparative manner.

In FIGS. 4A and 4B, a stroke of the conventional damping piston 105 and a stroke of the damping piston 5 of the present embodiment are indicated by Sd1 and Sd2, respectively, and pressure in the conventional damping chamber 151 and pressure in the damping chamber 51 of the present embodiment are indicated by Pd1 and Pd2, respectively.

A relation between the reflected energy Er and Sd1, Sd2, Pd1, and Pd2 is expressed by formula (6) below:

$$Er=Pd1\times Sd1=Pd2\times Sd2 \quad (6).$$

In FIG. 4B, the pressure Pd2 is a hydraulic pressure while the damping piston 5 is retracting, and, because hydraulic fluid in the damping chamber 51, which has nowhere to go because being restricted by the check valve 9, has its pressure raised due to passage resistance when leaking from clearance at the locations of sliding contact and a relation Pd2>Pd1 thus holds, a relation Sd2<Sd1 holds. Therefore, it is clear that the retracting stroke of the damping piston 5 of the present embodiment is shorter than the retracting stroke of the conventional damping piston 105.

In addition, because the pressure in the damping chamber 51 of the present embodiment changes from Pd2 to Pd1 and vice versa between the cushioning stroke and the advancing stroke satisfying Pd2>Pd1, hysteresis occurs, and the hysteresis becomes damping energy. The damping energy is energy consumed as heat energy in the cushioning stroke as described above, and, when being denoted by Ed, the damping energy Ed is expressed by formula (7) below:

$$Ed=(Pd2-Pd1)\times Sd2 \quad (7).$$

In other words, the damping energy Ed is equivalent to the hatched portion in FIG. 4B.

When energy returned to transmission members of the conventional cushioning mechanism and energy returned to transmission members of the cushioning mechanism of the present invention are denoted by Er'1 and Er'2, respectively, the following relations hold from FIGS. 4A and 4B:

$$Er'1=Pd1\times Sd1(=Er);$$

$$Er'2=Pd2\times Sd2; \text{ and}$$

$$Sd1>Sd2, \text{ and}$$

$$\text{therefore, } Er'1>Er'2.$$

Figure 12:
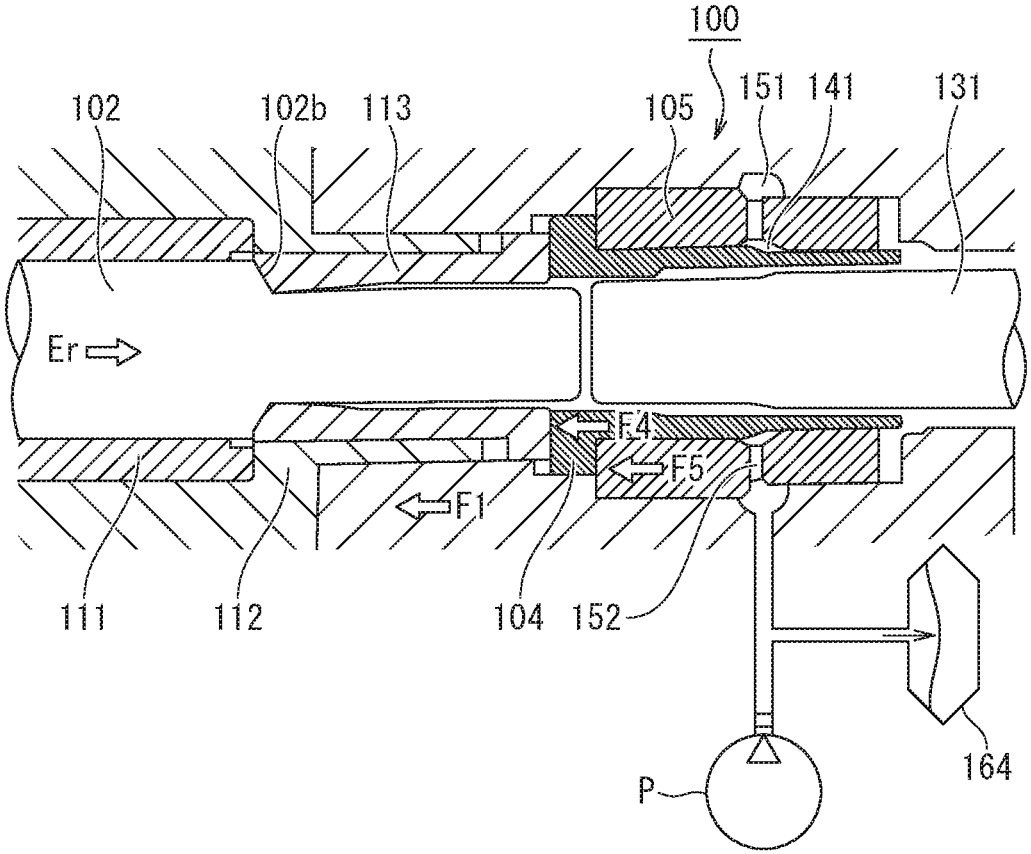
FIG. 12 (Prior Art)
FIG. 12 is an explanatory diagram of an example of a cushioning mechanism of a conventional rock drill.

In other words, compared with the conventional cushioning mechanism illustrated in FIG. 12, the cushioning mechanism of the present embodiment enables energy returned to transmission members to be substantially reduced. For this reason, the cushioning mechanism of the present embodiment contributes to load reduction on the transmission members and, in particular, produces a greater effect as blow energy increases.

Figure 5:
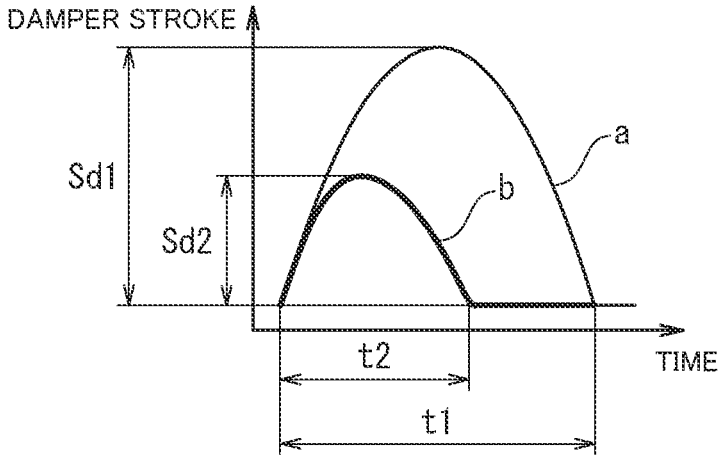
FIG. 5 is an operational explanatory diagram of the cushioning mechanism in FIG. 2 and the drawing illustrates a relationship between time and displacement of the damping pistons.

FIG. 5 is a diagram schematically illustrating a relationship between a stroke of the damping piston 5 and cushioning period of the damping chamber 51 and illustrates a case (a) of the conventional cushioning mechanism described in FIG. 12 and a case (b) of the cushioning mechanism of the present embodiment in a comparative manner. Note that a stroke of the conventional damping piston 105 illustrated in FIG. 12 and a stroke of the damping piston 5 of the present embodiment are indicated by Sd1 and Sd2, respectively, and a cushioning period of the conventional damping mechanism and a cushioning period of the damping mechanism of the present embodiment are indicated by t1 and t2, respectively.

Because, as described above, the retracting stroke of the damping piston 5 of the present embodiment is shorter than the retracting stroke of the conventional damping piston 105 as Sd2<Sd1, it can be seen that the cushioning period is also reduced as t2<t1, as illustrated in FIG. 5. A short retracting stroke of the damping piston 5 enables a rapid transition to a succeeding advancing stroke. Therefore, the cushioning mechanism of the present embodiment may complete both the cushioning stroke and the advancing stroke in a short period of time and, in particular, produces a greater effect as the number of blows per unit time increases.

The hydraulic hammering device according to the present invention is not limited to the above-described first embodiment. Hereinafter, other embodiments will be further described.

Second Embodiment

Figure 6:
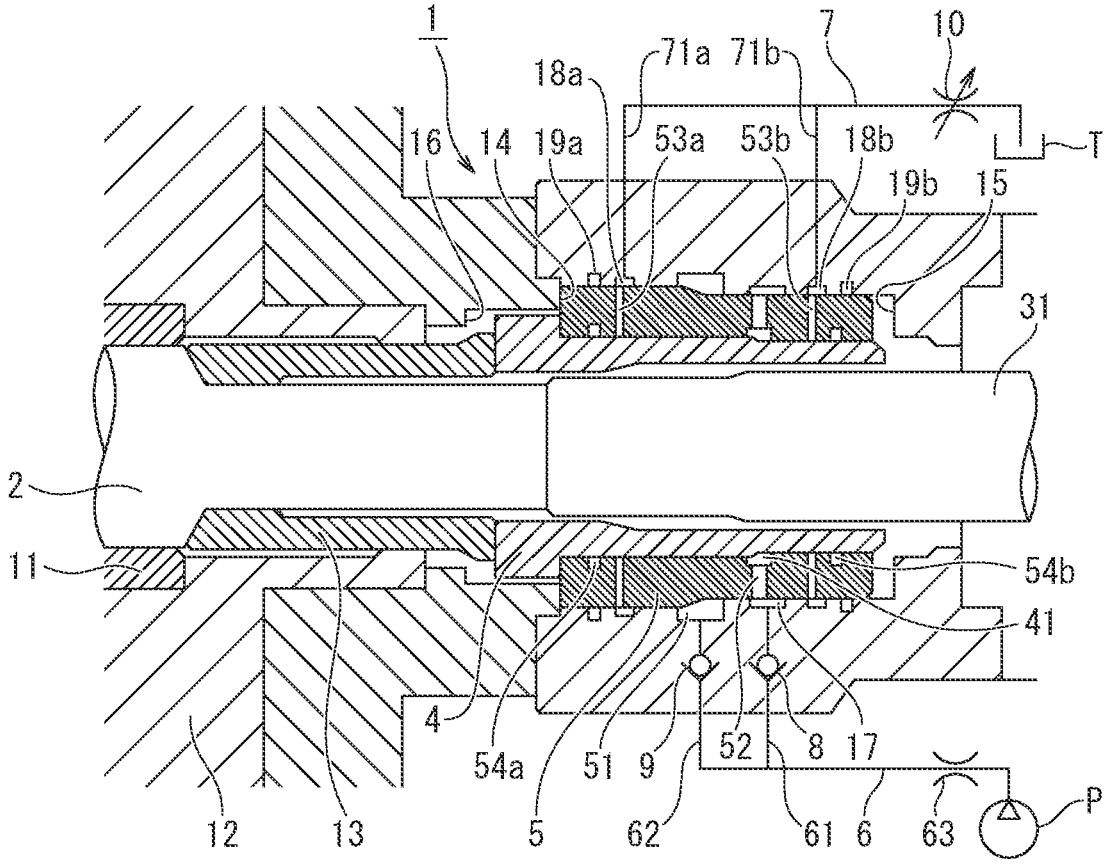
FIG. 6 is a longitudinal sectional view of a cushioning mechanism of a rock drill indicative of a second embodiment of the present invention.

FIG. 6 illustrates a second embodiment of the present invention. The second embodiment has the same configuration as the above-described first embodiment except that a second throttle 63 is added to a high-pressure circuit 6. The amount of flow rate adjustment (the amount of throttling) by the second throttle 63 is set smaller than the amount of flow rate adjustment by a variable throttle 10.

Although in high-pressure passages 61 and 62, as with the above-described first embodiment, check valves 8 and 9 are interposed as direction-restricting means, the check valves 8 and 9 having a very little internal leakage cannot be avoided because of the nature of hydraulic equipment. Therefore, it is difficult to completely prevent hydraulic fluid from flowing out.

When an outflow of hydraulic fluid occurs in the high-pressure circuit 6 as described above, pulsation of the hydraulic fluid having flowed out is liable to adversely affect hydraulic equipment, such as a not-illustrated control valve and hydraulic piping. Because the second throttle 63 is thus interposed in the high-pressure circuit 6 between the check valves 8 and 9, which are direction-restricting means, and a hydraulic pump P, so-called double direction-restricting means are provided. A problem of hydraulic fluid outflow in the high-pressure circuit 6 may be thereby solved.

Third Embodiment

Figure 7:
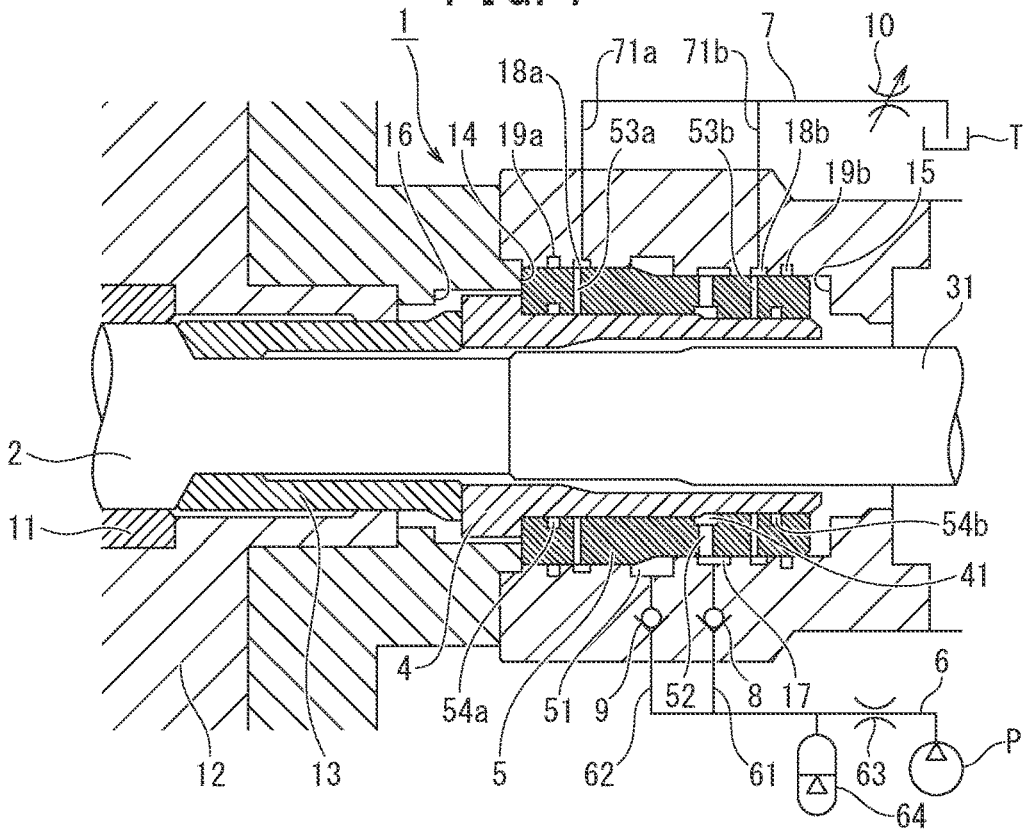
FIG. 7 is a longitudinal sectional view of a cushioning mechanism of a rock drill indicative of a third embodiment of the present invention.

FIG. 7 illustrates a third embodiment of the present invention. The third embodiment has the same configuration as the above-described second embodiment except that an accumulator 64 is added to a high-pressure circuit 6 between check valves 8 and 9 and a second throttle 63 that are interposed in the high-pressure circuit 6.

As described above, interposing the second throttle 63 in the high-pressure circuit 6 as a countermeasure against an outflow in the high-pressure circuit 6 is effective. However, it is unavoidable that the second throttle 63 interposed in the high-pressure circuit 6 also works as resistance against supply of hydraulic fluid from the side on which a hydraulic pump P is placed to the sides on which a pushing chamber 41 and a damping chamber 51 are formed.

In contrast, even when the feed of hydraulic fluid in the pushing chamber 41 and the damping chamber 51 is deficient because of an outflow of hydraulic fluid at the moment when the cushioning stroke turns to the advancing stroke, addition of the accumulator 64 to the high-pressure circuit 6 between the check valves 8 and 9 and the second throttle 63 enables hydraulic fluid having flowed out to be accumulated in the accumulator 64, which makes it possible to make up for deficient hydraulic fluid by discharging and feeding the accumulated hydraulic fluid into the pushing chamber 41 and the damping chamber 51. Because hydraulic fluid having flowed out is restricted from flowing out beyond the second throttle 63 to the side on which the hydraulic pump P is placed and most of the hydraulic fluid is accumulated in the accumulator 64, the accumulator excels in usage efficiency.

In addition, although pulsation of hydraulic fluid caused by strikes sometimes occurs in the high-pressure circuit 6 between the check valves 8 and 9 and the second throttle 63, the accumulator 64 enables such pulsation to die out quickly. Although there is a risk that, in, in particular, a striking mechanism capable of delivering a large number of blows, a next pulsation occurring before a current pulsation is damped doubles the amplitude of the pulsations and the doubled pulsations damage equipment, disposition of the accumulator 64 enables the pulsation problem to be solved.

Fourth Embodiment

Figure 8:
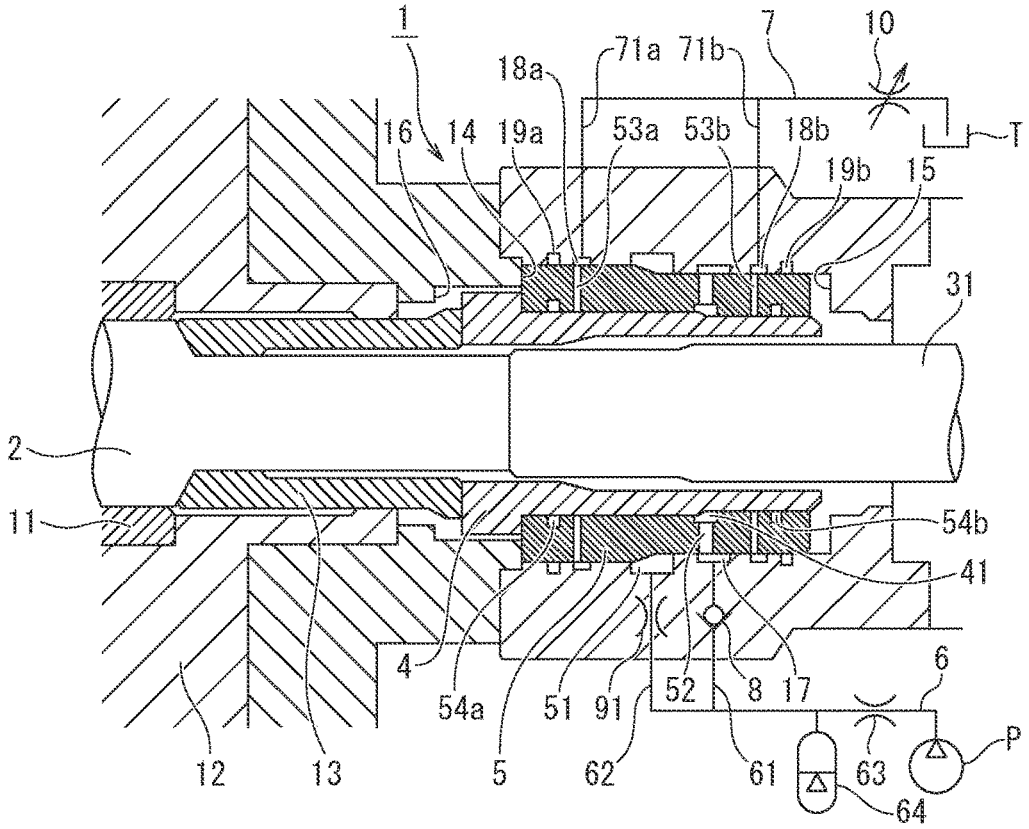
FIG. 8 is a longitudinal sectional view of a cushioning mechanism of a rock drill indicative of a fourth embodiment of the present invention.

FIG. 8 illustrates a fourth embodiment of the present invention. The fourth embodiment has the same configuration as the above-described third embodiment except that a throttle 91 is interposed in place of a check valve 9 as a direction-restricting means in a high-pressure passage 62.

For example, in some cases, depending on the specifications of a rock drill, the wavelength of generated reflected waves shortens and the length of a time period during which the reflected waves act on a cushioning mechanism also shortens. In such a case, the cushioning mechanism is required to exert sufficient cushioning action in a short period of time and, to fulfill the requirement, required to increase the response speed of the direction-restricting means.

While a throttle is employable as a direction-controlling means in addition to a check valve, a throttle excels a check valve in the response speed of cushioning action. On the other hand, a check valve excels a throttle in advancing speed after the cushioning stroke has turned to the advancing stroke. Therefore, in the fourth embodiment, the throttle 91 is employed as a direction-controlling means in a damping passage 62, and a check valve 8 is employed as a direction-controlling means in a pushing passage 61. Note that the amounts of adjustments of the respective throttles in the fourth embodiment have a relationship such that the amount of adjustment of the throttle 91 as a direction-controlling means is smaller than the amount of adjustment of a variable throttle 10 in a drain circuit 7 that is smaller than the amount of adjustment of a second throttle 63.

Fifth Embodiment

Figure 9:
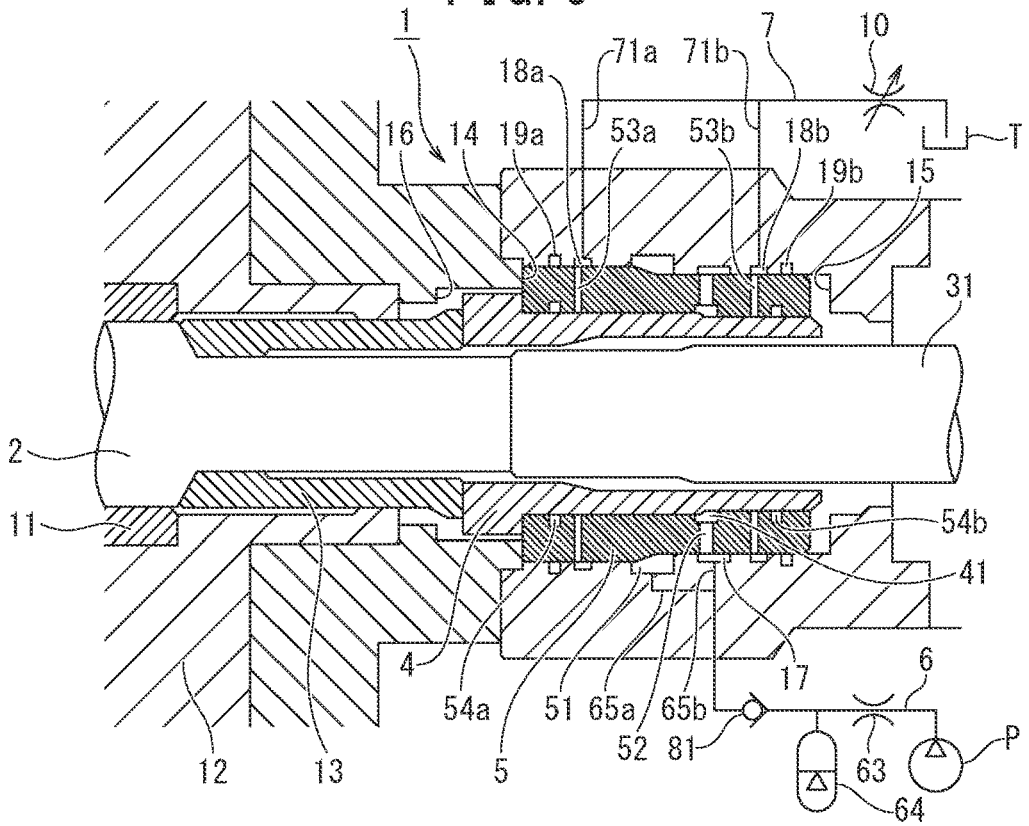
FIG. 9 is a longitudinal sectional view of a cushioning mechanism of a rock drill indicative of a fifth embodiment of the present invention.

FIG. 9 illustrates a fifth embodiment of the present invention. The fifth embodiment has the same configuration as the above-described third embodiment except that a high-pressure passage or circuit 6 branches into branch passages 65*a* and 65*b*, and the branch passage 65*a* and 65*b* are connected to a damping chamber 51 and a pushing port 17, respectively, and a check valve 81 is interposed as a direction-restricting means at a position on the side on which a pump P is placed beyond a branch point between the two branch passages 65*a* and 65*b*. Such a configuration described above enables the number of direction-restricting means to be reduced by one, which enables the configuration to be simplified and a cost to be reduced.

Sixth Embodiment

Figure 10:
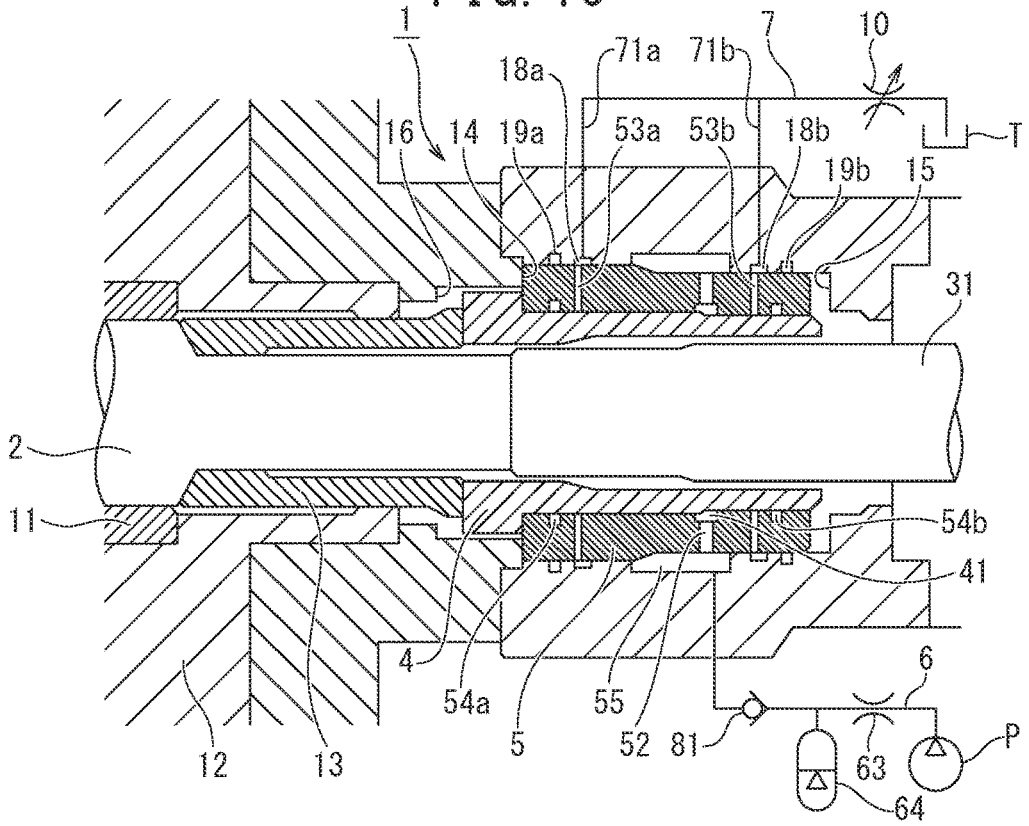
FIG. 10 is a longitudinal sectional view of a cushioning mechanism of a rock drill indicative of a sixth embodiment of the present invention.
Figure 11:
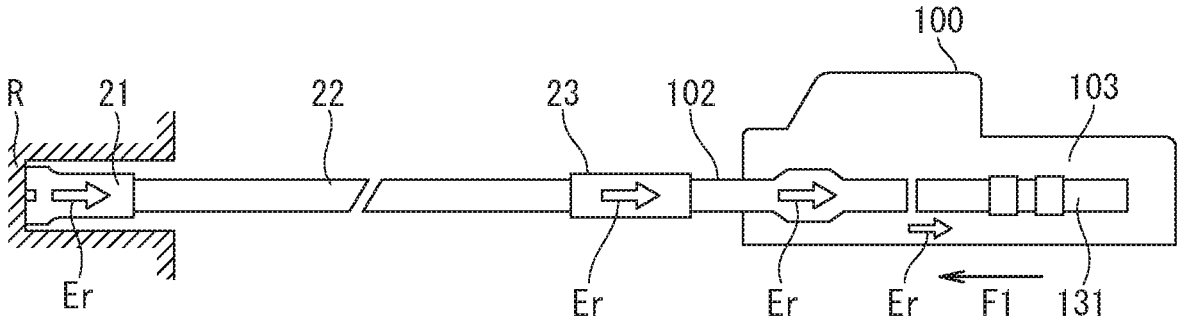
FIG. 11 (Prior Art)
FIG. 11 is an explanatory diagram of a basic configuration of a rock drill.

FIG. 10 illustrates a sixth embodiment of the present invention. The sixth embodiment has the same configuration as the above-described fifth embodiment except that a damping chamber 51 and a pushing port 17 are combined into a cushioning chamber 55 and a high-pressure circuit 6 is connected to the cushioning chamber 55 without branching. Such a configuration enables the number of ports to be reduced by one, which enables the configuration to be simplified and the cost to be reduced.

Note that the above-described fifth and sixth embodiments are embodiments for, by combining hydraulic systems that are, in the other embodiments, individually provided to the respective ones of a pushing piston 4 and a damping piston 5 into one hydraulic system, achieving a simplification in a configuration and a reduction in cost. However, sharing hydraulic systems causes influence of pulsation of hydraulic fluid occurring caused by the operations of the respective ones of the pushing piston 4 and the damping piston 5 to be also shared. In addition, when the hydraulic systems are shared, it is impossible to, as in the fourth embodiment, determine specifications of direction-restricting means according to respective characteristics of the pushing piston 4 and the damping piston 5.

Although the embodiments of the present invention were described above with reference to the accompanying drawings, the hydraulic hammering device according to the present invention is not limited to the above-described embodiments, and it is apparent that, unless departing from the spirit and scope of the present invention, other various modifications and alterations to the respective components can be made and the components in the above-described embodiments can be appropriately combined with one another.

The following is a list of reference signs.

1 Rock drill main body
2 Shank rod
2*a* Large diameter section rear end
3 Striking mechanism
4 Pushing piston
5 Damping piston
6 High-pressure circuit
7 Drain circuit
8 Check valve (direction-restricting means)
9 Check valve (direction-restricting means)
10 Variable throttle
11 Chuck
12 Chuck driver
13 Chuck driver bush
14 Middle step section
14*a* Inner large diameter section
15 Rear step section
15*a* Inner small diameter section
16 Front step section
17 Pushing port
18*a*, 18*b* Drain port
19*a*, 19*b* Seal
21 Bit
22 Rod
23 Sleeve
31 Striking piston
40*a* Outer large diameter section
40*b* Outer medium diameter section
40*c* Outer small diameter section
40*d*, 40*e* Front end face, Middle end face
41 Pushing chamber
50*a*, 50*b* Outer large diameter section, Outer small diameter section
50*c*, 50*d* Inner large diameter section, Inner small diameter section
50*e*, 50*f* Front end face, Rear end face
51 Damping chamber (damping port)
52 Fluid feeding hole
53*a*, 53*b* Drain hole
54*a*, 54*b* Seal
55 Cushioning chamber
61 Pushing passage
62 Damping passage
63 Throttle
64 Accumulator
65*a*, 65*b* Branch passage
71*a*, 71*b* Drain passage
81 Check valve (direction-restricting means)
91 Throttle (direction-restricting means)
Er Reflected energy
P Hydraulic pump
R Bedrock
T Tank

The invention claimed is:

1. A hydraulic hammering device comprising:

a transmission member configured to transmit a propulsive force toward a crushing target side to a tool;

a hammering mechanism configured to strike a blow on a rear portion of the transmission member;

a pushing piston disposed immediately behind a portion of the transmission member, the pushing piston having a smaller propulsive force than a propulsive force of a device main body of the hydraulic hammering device;

a damping piston positioned behind a portion of the pushing piston and disposed to slide reciprocally against the pushing piston in forward and backward directions, the damping piston having a greater propulsive force than the propulsive force of the device main body of the hydraulic hammering device;

a pushing chamber configured to be supplied with hydraulic fluid from a fluid supply source to provide the pushing piston with the smaller propulsive force;

a damping chamber configured to be supplied with hydraulic fluid from the fluid supply source to provide the damping piston with the greater propulsive force;

a drain circuit configured to discharge a leakage of hydraulic fluid from a location of sliding contact between the pushing piston and the damping piston to a tank, the drain circuit being separated from the damping chamber and the pushing chamber by sliding contact between the device main body and the damping piston;

a direction-restrictor provided in a high-pressure circuit between the damping chamber and the pushing chamber, and the fluid supply source, the direction-restrictor being configured to restrict an outflow of hydraulic fluid from a side of the direction-restrictor relative to the damping chamber and the pushing chamber to a side of the direction-restrictor relative to the fluid supply source, while allowing an inflow of hydraulic fluid from the side of the direction-restrictor relative to the fluid supply source to the side of the direction-restrictor relative to the damping chamber and the pushing chamber; and a throttle provided in the drain circuit.

2. The hydraulic hammering device according to claim 1, further comprising:

a second throttle provided in a high-pressure circuit between the direction-restrictor and the fluid supply source, wherein an amount of flow rate adjustment by the second throttle is set to be lower than an amount of flow rate adjustment by the throttle provided in the drain circuit.

3. The hydraulic hammering device according to claim 2, further comprising:

an accumulator provided in a high-pressure circuit between the direction-restrictor and the second throttle.

4. The hydraulic hammering device according to claim 1, wherein the direction-restrictor includes a first direction-restrictor and a second direction-restrictor respectively provided in a first high-pressure circuit between the damping chamber and the fluid supply source and a second high-pressure circuit between the pushing chamber and the fluid supply source, and the second direction-restrictor is a check valve, and the first direction-restrictor is a throttle or a check valve.

5. The hydraulic hammering device according to claim 2, wherein the direction-restrictor includes a first direction-restrictor and a second direction-restrictor respectively provided in a first high-pressure circuit between the damping chamber and the fluid supply source and a second high-pressure circuit between the pushing chamber and the fluid supply source, and the second direction-restrictor is a check valve, and the first direction-restrictor is a throttle or a check valve.

6. The hydraulic hammering device according to claim 3, wherein the direction-restrictor includes a first direction-restrictor and a second direction-restrictor respectively provided in a first high-pressure circuit between the damping chamber and the fluid supply source and a second high-pressure circuit between the pushing chamber and the fluid supply source, and the second direction-restrictor is a check valve, and the first direction-restrictor is a throttle or a check valve.

7. The hydraulic hammering device according to claim 1, wherein a first drain port and a second drain port are provided on an inner peripheral surface of the main body facing an outer peripheral surface of the damping piston, the first drain port being separated from the damping chamber forward in the axis direction, the second drain port being separated from the damping chamber backward in the axis direction, one end of the drain circuit is connected to the tank and an other end of the drain circuit splits into a first drain passage and a second drain passage, and the first drain passage is connected to the first drain port and the second drain passage is connected to the second drain port.

8. The hydraulic hammering device according to claim 1, wherein the transmission member includes a chuck driver bush and the pushing piston is disposed immediately behind the chuck driver bush.

9. The hydraulic hammering device according to claim 1, wherein the pushing piston includes an outer large diameter section forming a face that a front end face of the dampening piston is located behind and is in contact.

10. The hydraulic hammering device according to claim 1, wherein at least a portion of the pushing piston and the dampening piston extend around the hammering mechanism and the hammering mechanism is a striking piston.

11. The hydraulic hammering device according to claim 1, wherein the dampening piston includes a drain hole a front seal is located on an inner peripheral surface of the dampening piston on a front side of the drain hole and a rear seal is located on the inner peripheral surface of the dampening piston on a rear side of the drain hole.

12. The hydraulic hammering device according to claim 1, wherein the drain circuit includes two drain ports.

13. The hydraulic hammering device according to claim 12, wherein the drain circuit includes two drain holes and two drain passages.

14. The hydraulic hammering device according to claim 13, wherein the each of the two drain ports are in a position facing a drain hole of the dampening position.

* * * * *